US007117593B2

(12) United States Patent
Ju

(10) Patent No.: US 7,117,593 B2
(45) Date of Patent: Oct. 10, 2006

(54) METHOD FOR PRODUCING ELECTRICAL CONNECTOR

(76) Inventor: Ted Ju, P.O. Box 26-757, Taipei 106 (TW)

( * ) Notice: Subject to any disclaimer, the term of this patent is extended or adjusted under 35 U.S.C. 154(b) by 0 days.

(21) Appl. No.: 11/052,517

(22) Filed: Feb. 8, 2005

(65) Prior Publication Data

US 2006/0174481 A1 Aug. 10, 2006

(51) Int. Cl.
*H01R 43/04* (2006.01)
*H01R 13/41* (2006.01)

(52) U.S. Cl. ..... 29/884; 29/33 M; 29/882; 29/883; 29/885; 29/749; 29/755; 439/722; 439/736

(58) Field of Classification Search ..... 29/33 M, 29/874, 882, 883, 884, 885, 828, 826, 827, 29/896, 898, 509, 512, 513, 34 D, 564.5, 29/564.6, 749, 745–747, 755; 439/722, 736
See application file for complete search history.

(56) References Cited

U.S. PATENT DOCUMENTS 1,958,687 A * 5/1934 Wolcott ..... 174/107
4,349,944 A * 9/1982 Fickes ..... 29/566.4
6,663,425 B1 * 12/2003 Zhang et al. ..... 439/607

* cited by examiner

*Primary Examiner*—Peter Vo
*Assistant Examiner*—Livius Radu Cazan
(74) *Attorney, Agent, or Firm*—Rosenberg, Klein & Lee

(57) ABSTRACT

An electrical connector and a method for producing the same are described. The electrical connector has an insulative housing and a plurality of metallic wires. The insulative housing has a plurality of slots formed therein, and the slots are defined with a width less than that of the metallic wire. The metallic wires are set into the slots and further are folded. Each of the metallic wires has a contact portion protruding out of a surface of the insulative housing for electrically connecting the electrical component.

4 Claims, 6 Drawing Sheets

METHOD FOR PRODUCING ELECTRICAL CONNECTOR

BACKGROUND OF THE INVENTION

1. Field of the Invention

The present invention relates to an electrical connector and a method for producing the same.

2. Description of Related Art

The conventional electrical connector generally includes an insulative housing and a plurality of contacts received in respective channels, which are formed in lateral walls of the insulative housing. The insulative housing further includes a plurality of engaging slots formed in a bottom thereof and communicating with the channels. Pluralities of engaging portions disposed on the contacts are pressed into the engaging slots to mate with the insulative housing. Such a connector is not cheap and is difficult to manufacture and assemble.

SUMMARY OF THE INVENTION

An electrical connector and a method for producing the same are provided for cheap, easy manufacture and simple assembly.

An electrical connector includes an insulative housing and a plurality of metallic wires. The insulative housing has a plurality of slots formed therein, and the slots are defined with a width less than that of the metallic wire. The metallic wires are set into the slots and further are folded. Each of the metallic wires has a contact portion protruding out of a surface of the insulative housing for electrically connecting the electrical component.

A method for producing the electrical connector includes the following steps. (1) An insulative housing having a plurality of slots and a plurality of metallic wires is provided. The slots are defined with a width less than that of the metallic wire. (2) The mold and the insulative housing are pressed together to fold and embed simultaneously the metallic wires into the slots thereof. Each of the metallic wires has a contact portion protruding out of a surface of the insulative housing.

To provide a further understanding of the invention, the following detailed description illustrates embodiments and examples of the invention. Examples of the more important features of the invention have thus been summarized rather broadly in order that the detailed description thereof that follows may be better understood, and in order that the contributions to the art may be appreciated. There are, of course, additional features of the invention that will be described hereinafter which will form the subject of the claims appended hereto.

BRIEF DESCRIPTION OF THE DRAWINGS

These and other features, aspects, and advantages of the present invention will become better understood with regard to the following description, appended claims, and accompanying drawings, where:

DETAILED DESCRIPTION OF PREFERRED EMBODIMENTS

Figure 1:
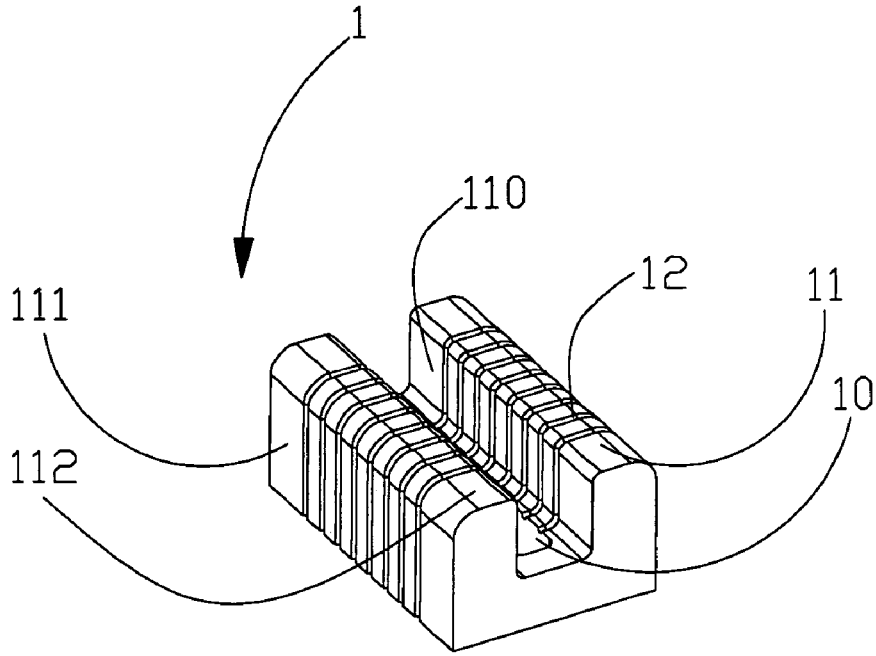
FIG. 1 is a perspective view of an electrical connector according to the present invention.
Figure 2:
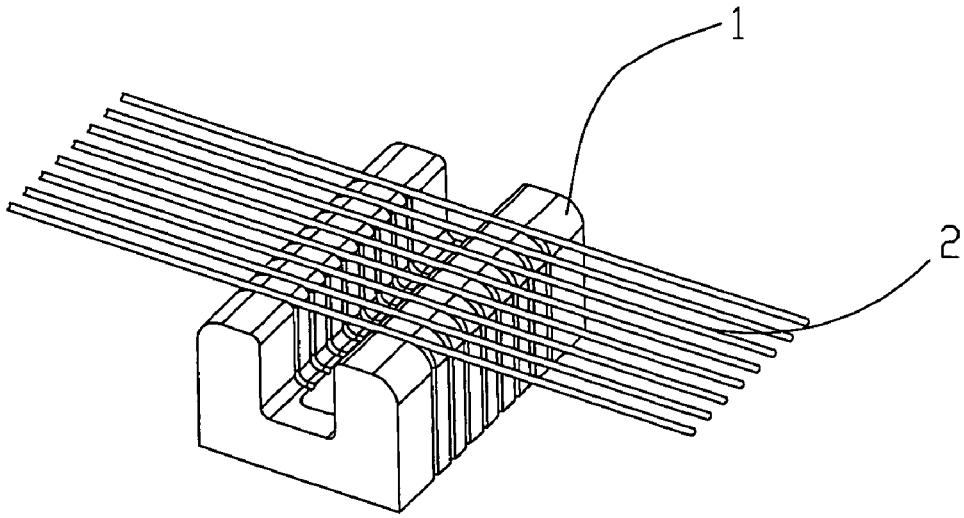
FIG. 2 is a perspective view according to the present invention during assembly of an insulative housing with metallic wires.
Figure 3:
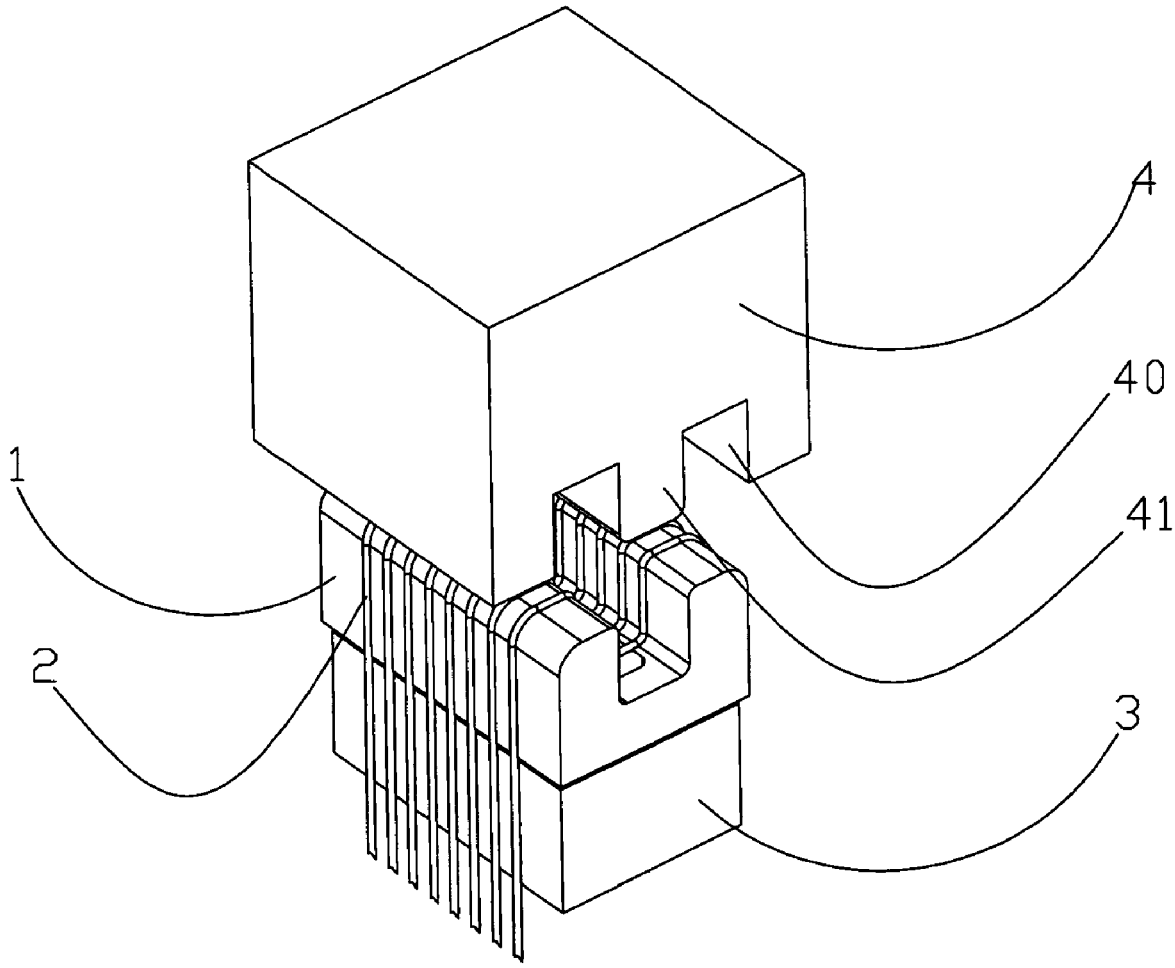
FIG. 3 is a decomposition view of the electrical connector, an upper mold and a lower mold according to the present invention.
Figure 4:
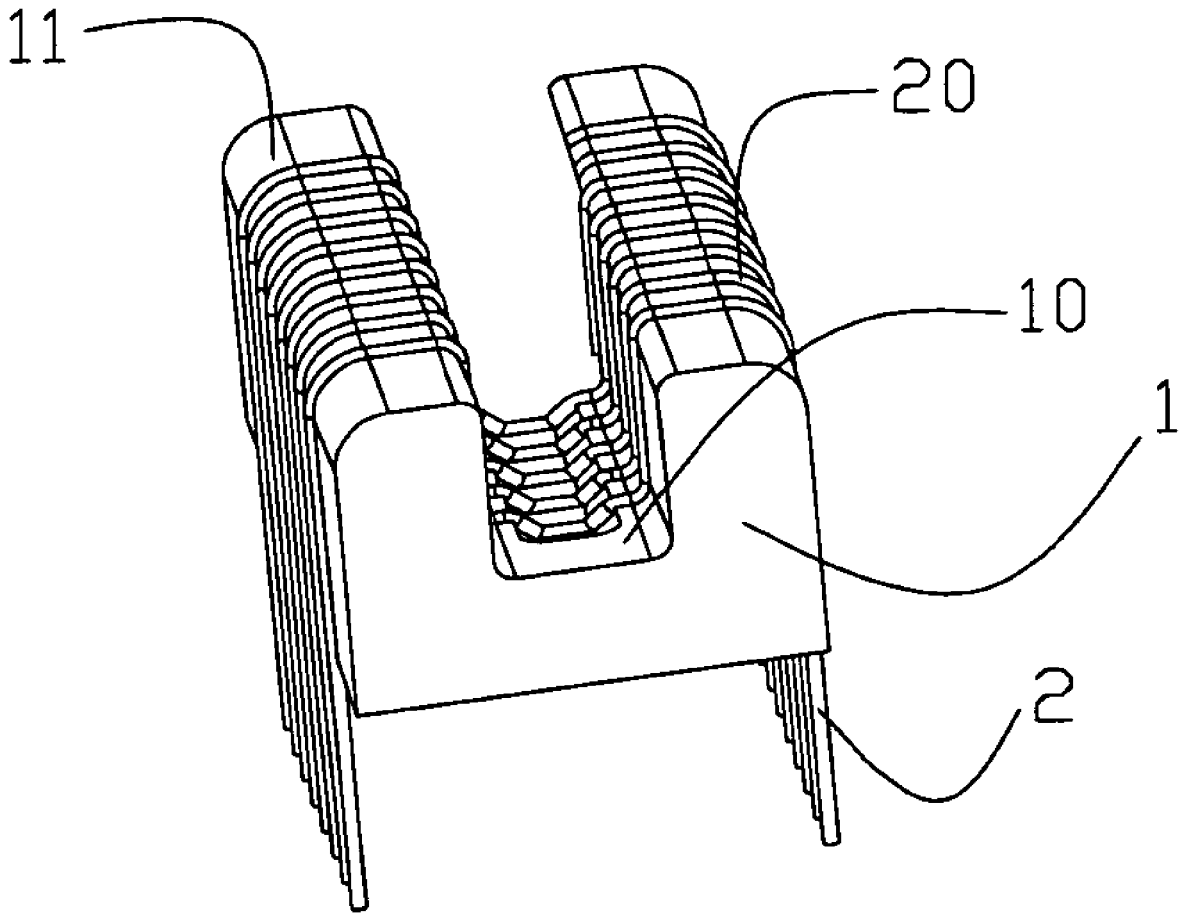
FIG. 4 is a perspective view of the electrical connector according to the present invention.

With respects to FIGS. 1 to 4, an electrical connector according to the present invention includes an insulative housing 1 and a plurality of metallic wires 2. The insulative housing 1 has a concave 10 formed in a middle thereof, two lateral sidewalls 11 adjacent to the concave 10, and a plurality of slots 12 formed continually over an exterior surface 111, an interior surface 110 and a top surface 112 of the sidewalls 11. The metallic wires 2 are set into the slots 12 of the insulative housing 1, respectively, and further folded. The slots 12 are defined with a width less than that of the metallic wires 2, in order to secure the metallic wires 2 in the insulative housing 1. Each of the metallic wires 2 has contact portion 20 protruding out of a surface of the insulative housing 1 for electrical connection. Two ends of each metallic wire 2 can be kept with proper length for forming a cord.

A method for producing the electrical connector includes the following steps. (1) An insulative housing 1 and a plurality of metallic wires 2 are provided. The insulative housing 1 has a concave 10 formed in a middle thereof, two lateral sidewalls 11 disposed adjacent to the concave 10, and a plurality of slots 12 formed continually over an exterior surface 111, an interior surface 110 and a top surface 112 of the sidewalls 11. The metallic wires 2 are provided with proper length and further placed over the slots 12 on the top surface 112 of the lateral sidewalls 11. (2) A retaining block 3 and a forming device 4 are provided. The insulative housing 1 and the metallic wires 2 are put on the retaining block 3, which has a width equal to or less than that of the insulative housing 1. The forming device 4 is approximately a rectangular solid, and has two troughs 40 in a lower surface thereof, corresponding to two lateral sidewalls 12 of the insulative housing 1. A projection 41 is disposed between the two troughs 40 and can be received inside the concave 10 of the insulative housing 1. The forming device 4 is pressed downwardly to force the metallic wires 2 to fold and embed simultaneously into the slots 12 of the insulative housing 1. Each of the metallic wires 2 has a contact portion 20 protruding out of the insulative housing 1 to electrically connect another component (not shown). The ends of each metallic wires 2 are substantially parallel to the sidewalls 11.

Figure 5:
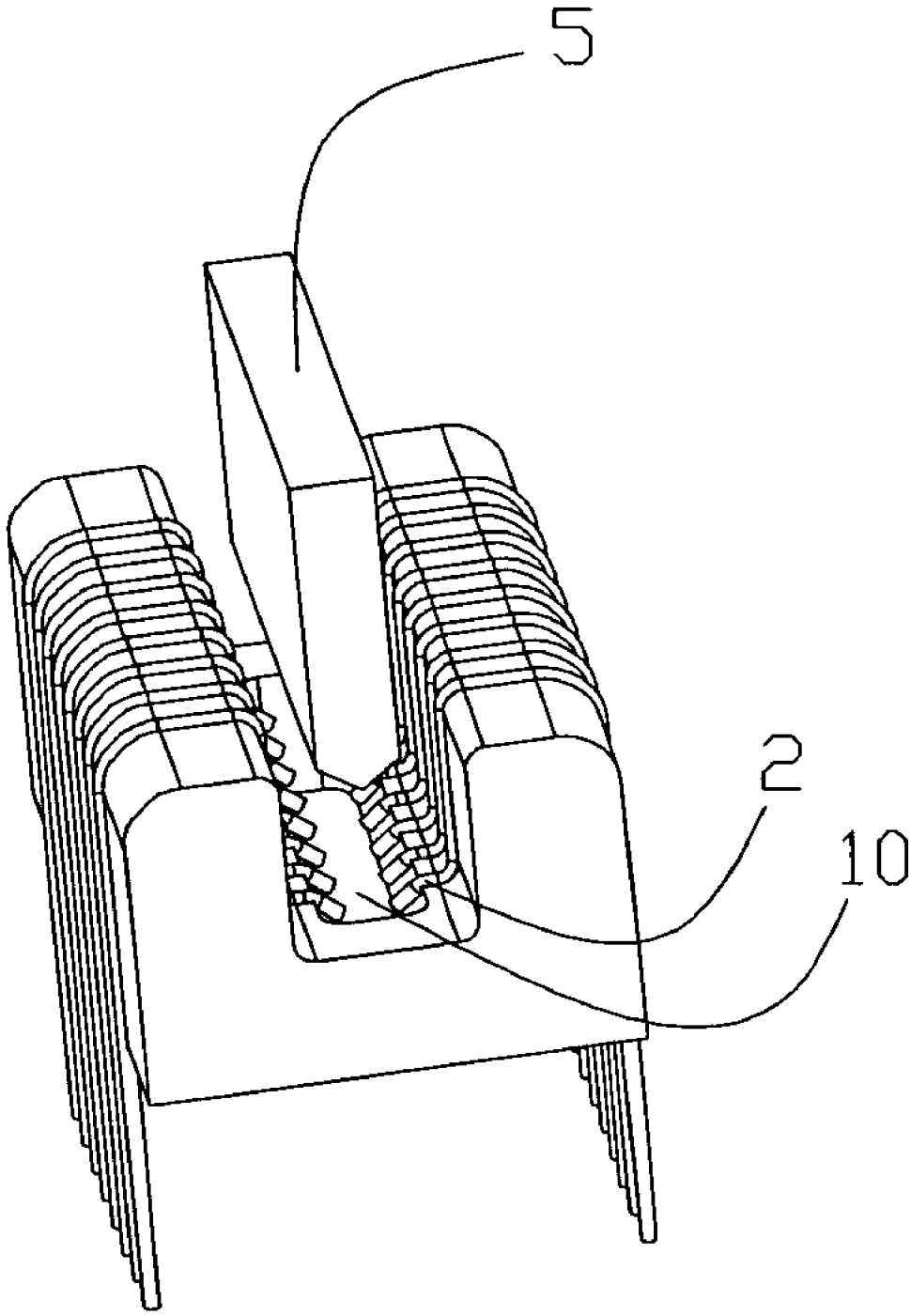
FIG. 5 is a perspective view of the electrical connector when the metallic wires are cut.

In addition, referring to FIG. 5, the metallic wires 2 in the concave 10 of the insulative housing 1 can be broken by a cutting device 5.

Figure 6:
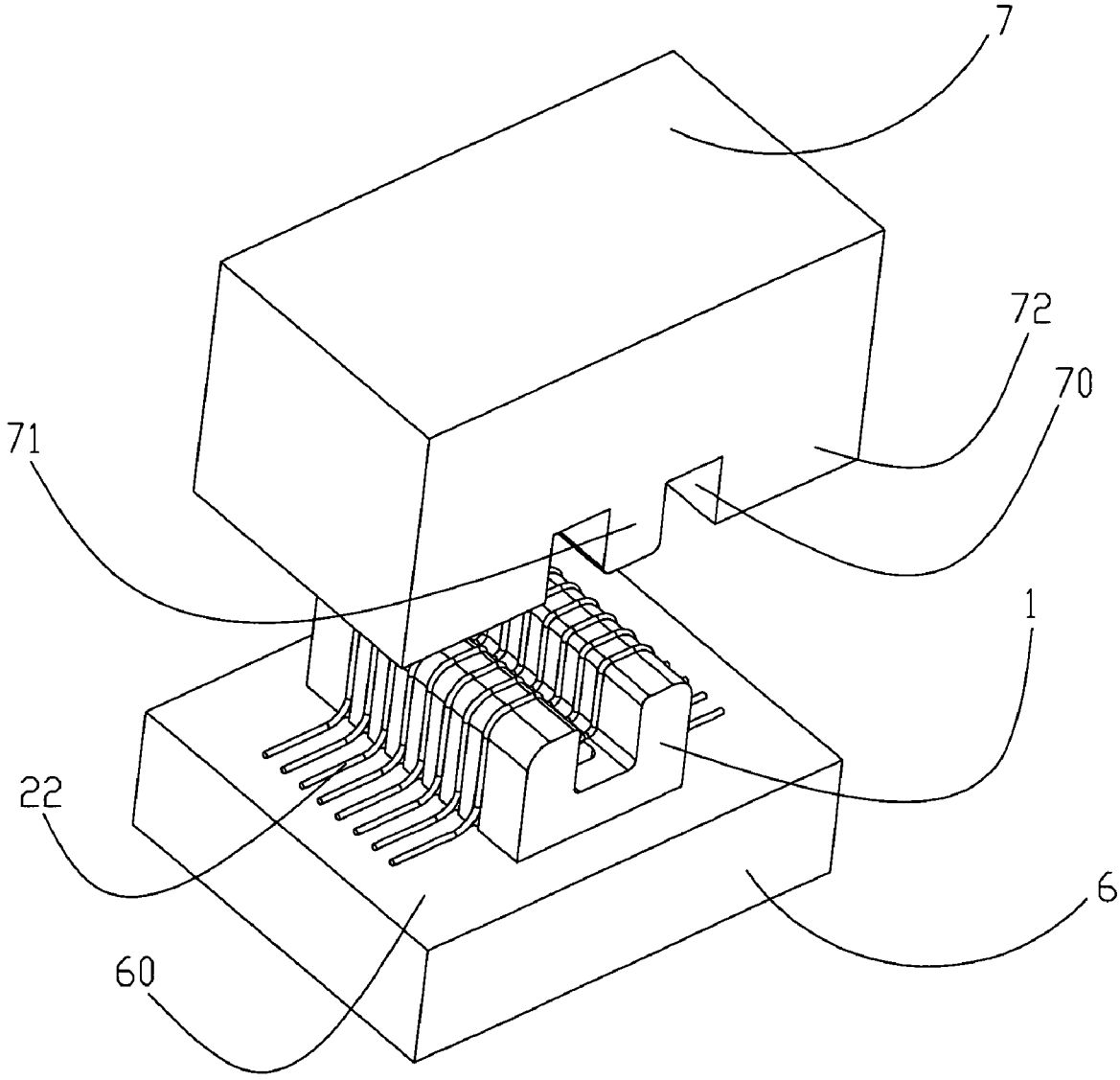
FIG. 6 is a decomposition view of the of the electrical connector, an upper mold and a lower mold according to another embodiment of the present invention.
Figure 7:
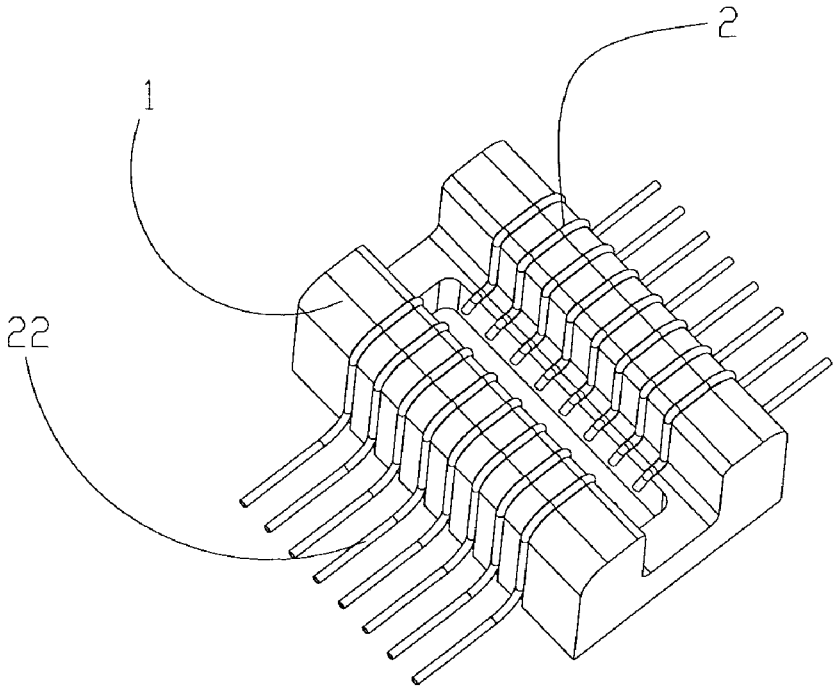
FIG. 7 is a perspective view according to FIG. 6.

With respect to FIGS. 6 and 7, the insulative housing 1 and the metallic wires 2 can be laid on a lower mold 6, which has a width greater than that of the insulative housing 1. The lower mold 6 has a smooth and clean top surface. An upper mold 7, which has two reception slots 70 formed in a bottom surface thereof and an orientation portion 71 disposed between the two reception slots 70 for placing into the concave 10 of the insulative housing 1, is provided. The upper mold 7 has two suppress portions 72 respectively adjacent to the reception slots 70. Each of the suppress portions 72 has a flat and smooth bottom surface. The upper mold 7 is provided to press the metallic wires 2 again to fold the ends of the wires 2 horizontally. The horizontal ends can be shortened with proper length as solder portions 22, which have a good coplanarity.

The configurations of the upper mold 7 and the lower mold 6 can be changed to suppress respective ends of the metallic wires 2, which are on the same side, and make them horizontal. Alternatively, the vertical ends of the metallic wires 2 at the other side of the insulative housing 1 can be folded along the bottom surface of the insulative housing 1 to combine with the horizontal ends as a cable.

Figure 8:
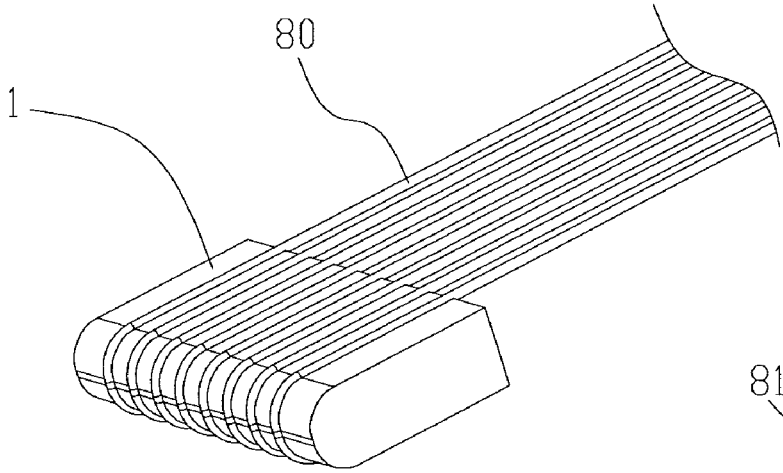
FIG. 8 is a perspective view in accordance with another embodiment of the electrical connector according to the present.
Figure 9:
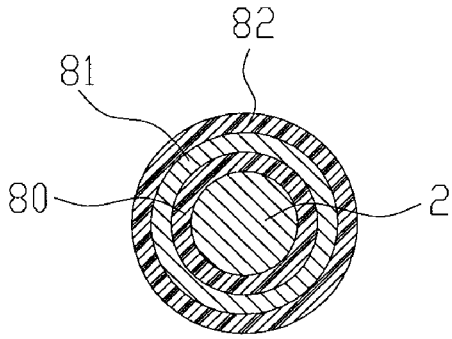
FIG. 9 is cross-sectional view of an alternate configuration of the wire of the electrical connector according to the present invention.

The cross-sectional configuration of the metallic wires can be round, equilaterally polygonal, or flat. Additionally, as shown in FIGS. 8 and 9, the metallic wires 2 can be coated with an isolative layer 80 of rubber, further coated with a conductive layer 81 over the isolative layer 80 for shielding, and then covered with another isolative layer 82 over the conductive layer 81. In another embodiment, the configuration of the insulative housing 1 can be varied as in *Fig*. 8.

Thus, by the method according to the present invention a cheap electrical connector is made with simple steps and easy manufacture.

It should be apparent to those skilled in the art that the above description is only illustrative of specific embodiments and examples of the invention. The invention should therfore cover various modifications and variations made to the herein-described structure and operation of the invention, provided they fall within the scope of the invention as defined in the following appended claims.

What is claimed is:

1. A method for producing an electrical connector, comprising the steps of:

providing an insulative housing with a plurality of slots, and a plurality of metallic wires corresponding to the slots, wherein the insulative housing has a longitudinally extending trough disposed between a pair of lateral sidewalls, each sidewall having an interior and an exterior surface, each of the slots being formed in the interior and exterior surfaces of the pair of lateral sidewalls and defined with a width less than that of the metallic wires;

providing an upper mold having a pair of longitudinally extending reception slots with a projection disposed therebetween and a pair of suppress portions respectively extending laterally from the pair of reception slots;

providing a lower mold having a substantially planar upper surface;

pressing the insulative housing between the upper and lower molds, the pair of lateral sidewalls of the insulative housing being respectively received in the pair of reception slots and the projection of the upper mold being received in the trough, the metallic wires thereby being folded and embedded into the slots of the insulative housing, wherein each of the metallic wires has a contact portion protruding out of the insulative housing; and inserting a cutting device into the trough to cut each of the plurality of metallic wires into two separate conductors of the electrical connector, each of the two conductors being associated with a respective one of the pair of lateral sidewalls.

2. The method as claimed in claim 1, further including the step of:

forming an isolative layer on each of the metallic wires.

3. The method as claimed in claim 2, wherein the step of forming an isolative layer includes the steps of covering the isolative layer with a conductive layer for shielding, and covering the conductive layer with another isolative layer.

4. The method as claimed in claim 1, further including:

providing a respective end of the metallic wires horizontally beside a lower portion of the insulative housing as a solder portion.

* * * * *